US005504513A

United States Patent [19]

Nobel et al.

[11] Patent Number: 5,504,513

[45] Date of Patent: Apr. 2, 1996

[54] DEFLECTION COMPENSATION FOR CARTRIDGE CARRIAGE WITH COMPLIANT WALLS

[75] Inventors: Gary M. Nobel; Craig A. Maurer, both of San Diego; Jason R. Arbeiter, Poway, all of Calif.

[73] Assignee: Hewlett-Packard Company, Palo Alto, Calif.

[21] Appl. No.: 232,909

[22] Filed: Apr. 25, 1994

[51] Int. Cl.[6] ..... B41J 2/175

[52] U.S. Cl. ..... 347/87; 347/49

[58] Field of Search ..... 347/49, 87

[56] References Cited

U.S. PATENT DOCUMENTS

| | | | |
|---|---|---|---|
| 4,872,026 | 10/1989 | Rasmussen et al. | 347/87 |
| 5,392,063 | 2/1995 | Rhoads | 347/49 |
| 5,434,603 | 7/1995 | Hunt | 347/87 |
| 5,448,275 | 9/1995 | Fong | 347/87 |
| 5,450,112 | 9/1995 | Scheffelin | 347/87 |

*Primary Examiner*—Benjamin R. Fuller
*Assistant Examiner*—Valerie Ann Lund

[57] ABSTRACT

An inkjet printer (10) has a movable carriage (12) supported above an ink-receiving medium by a rail (14) defining a carriage axis. A cartridge holder (16) is mounted on the carriage and having at least one cartridge compartment (18), each of the at least one compartment having a compliant compartment wall (82). Each compartment is providing with an opening at one end (19) of the carriage floor for receiving the snout (72) of an ink jet printer cartridge (20) on which is mounted a nozzle plate with more that one nozzle for depositing ink onto the ink-receiving medium. Each compartment is also provided with equalizing structure for maintaining the cartridge substantially perpendicular to the carriage axis when the compliant compartment wall is deflected by a spring at the middle of the compartment forcing two datum surfaces on the cartridge against front and rear supporting surfaces on the compartment wall. The equalizing structure preferably includes a second opening (21) at the other end of the floor.

11 Claims, 9 Drawing Sheets

DEFLECTION COMPENSATION FOR CARTRIDGE CARRIAGE WITH COMPLIANT WALLS

TECHNICAL FIELD

The present invention relates generally to inkjet printers having at least one multi-nozzle cartridge each mounted in a respective compartment of a compliant cartridge holder and more particularly to a scheme for maintaining alignment of the cartridge when each of the at least one cartridge is aligned by being held against a wall of the compartment.

BACKGROUND ART

Commonly assigned (and therefore not necessarily prior art) U.S. patent application Ser. No. 08/057,241, entitled "Side Biased Datum Scheme For Inkjet Cartridge and Carriage" and filed 30 Apr. 1993, discloses an inkjet printer which has a movable carriage supported above an ink receiving medium by a rail defining a carriage axis. Mounted on the carriage is a cartridge holder which has at least one cartridge compartment each receiving a respective ink jet printer cartridge, and which has a leaf spring near the mid-point between the front and rear ends of each compartment for applying a lateral holding force to hold the cartridge laterally against a compartment wall. Each cartridge has an array of nozzles located on a nozzle plate mounted on the lower surface of a snout which, when the cartridge is installed, passes through an opening in the compartment floor located to the rear of the leaf spring. Because the compartment wall is made of compliant material (i.e., plastic) and because the stiffening effect otherwise provided by the floor is eliminated in the vicinity of the snout opening, the rear portion of the compartment wall is more compliant than, and will therefore deflect more than, its front portion.

SUMMARY OF THE INVENTION

It is an overall objective of the present invention to provide an inkjet printer having a relatively lightweight cartridge holder with relatively compliant walls which nevertheless accurately maintains the nozzle plate of the cartridge at the proper orientation relative to the carriage axis.

In accordance with an overall aspect of the present invention, an inkjet printer of the type having clamping means associated with each said compartment wall for exerting a holding force against the cartridge is also provided with equalizing means associated with each compartment for causing the cartridge in said compartment to assume a position such that the Y nozzle axis of said cartridge remains substantially perpendicular to the carriage axis as said compartment wall is deflected in response to said holding force being exerted.

According to one aspect of the invention, a snout opening is provided in the rear of the compartment floor, and a compensating opening is provided in the front of the compartment floor, thereby providing substantially equal deflection of respective supporting surfaces defined by rear and front portions of the wall and compensating for the deflection without regard to the amount of the holding force.

According to another aspect of the invention, the deflection of the two supporting surfaces is not equal, and the supporting surfaces position the cartridge at a bias angle when no holding force is applied, and the nozzle plate assumes its desired position only after a predetermined holding force has been applied.

BRIEF DESCRIPTION OF THE DRAWINGS

FIG. 2 comprising

FIG. 3 comprising

FIG. 5, comprising

DETAILED DESCRIPTION OF THE PREFERRED EMBODIMENT

Figure 1:
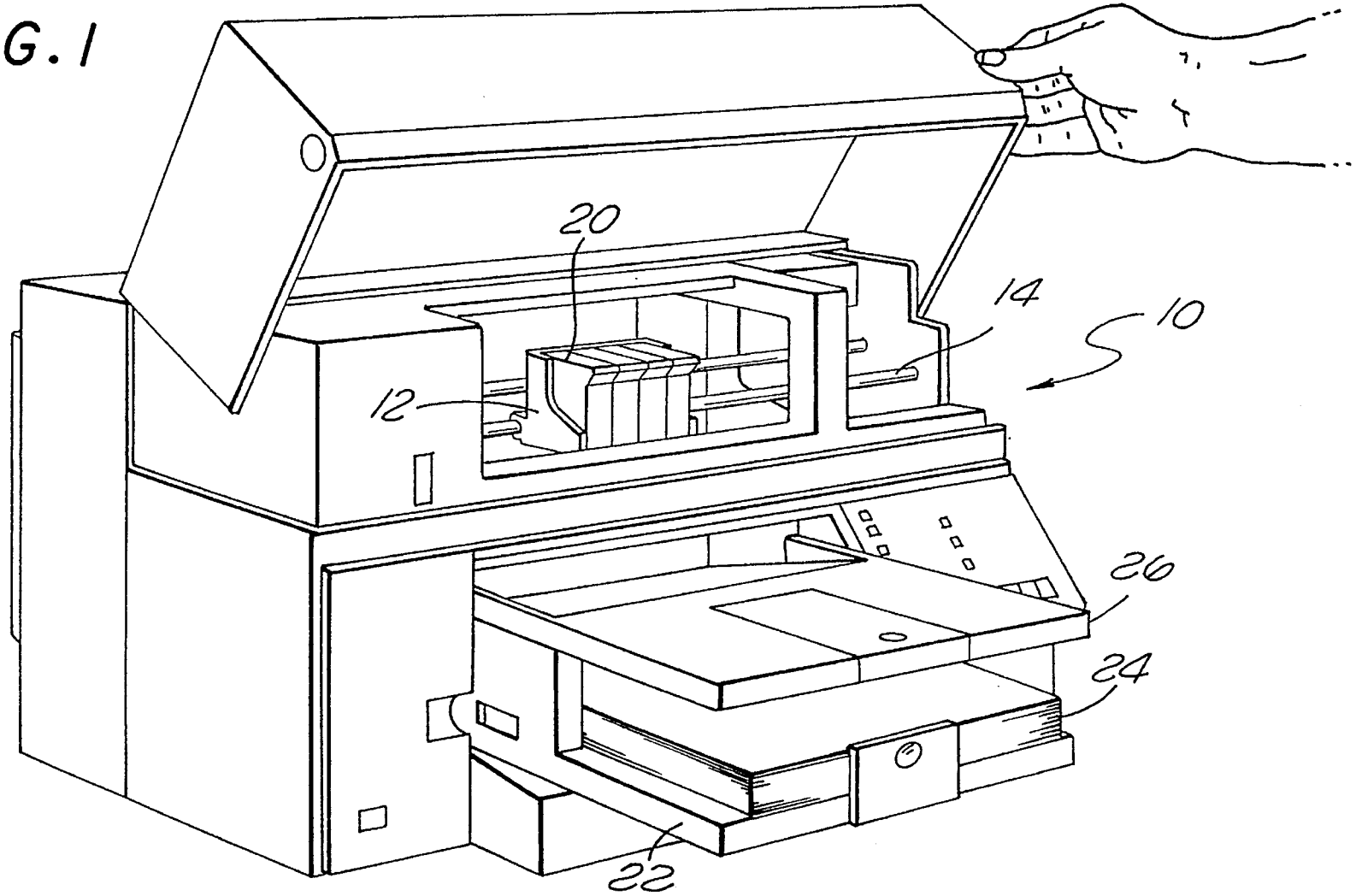
FIG. 1 is an isometric view showing the major components of an inkjet printer incorporating the present invention.

FIG. 1 shows a high quality inkjet printer 10 incorporating the present invention. In particular, inkjet printer 10 includes a movable carriage 12 supported on a rail 14. As best shown in FIG. 2C, movable carriage 12 includes a cartridge holder 16 provided with a plurality of individual cartridge compartments 18 for receiving a respective plurality of ink jet printer cartridges 20. Each cartridge 20 is supported above the ink-receiving medium 24 by the cartridge holder 16, such that a nozzle plate 30 on the lower surface 32 (FIG. 3B)

of the cartridge 20 is maintained an appropriate distance from the ink-receiving medium 24.

Figure 2A:
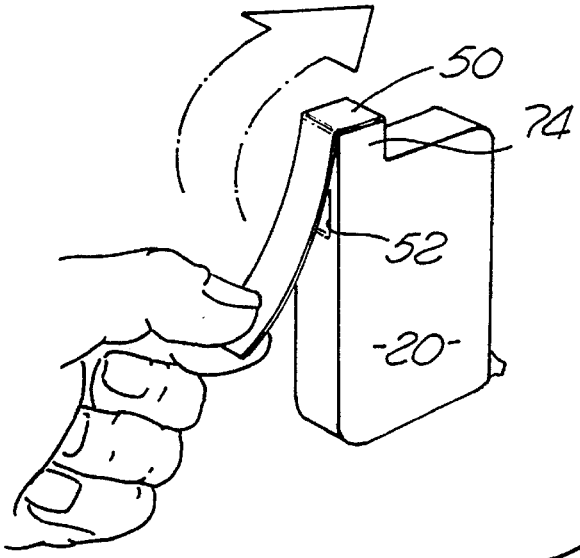
FIGS. 2A, 2B, and 2C are isometric views showing one of the printer "cartridges" of FIG. 1 being inserted into a corresponding slot of the cartridge holder.
Figure 2B:
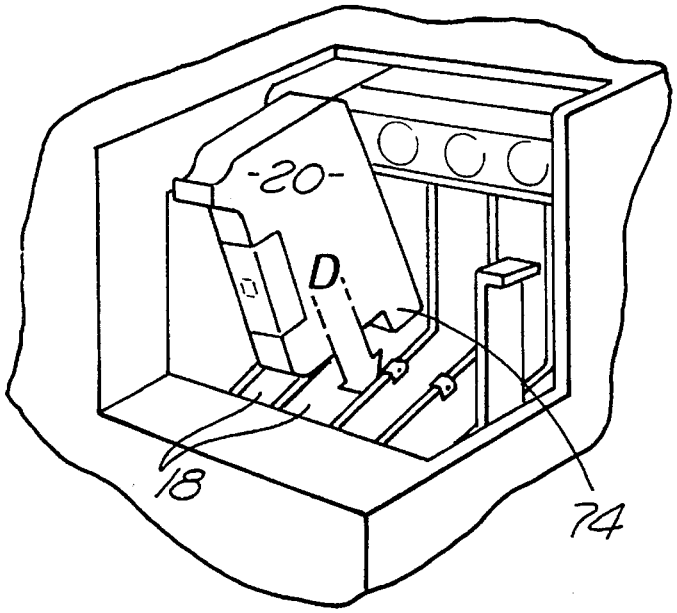
Figure 2C:
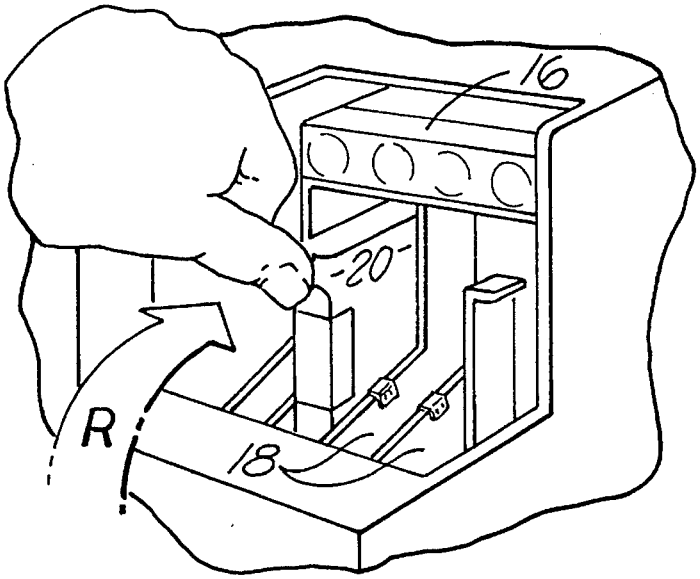

Referring now to FIG. 2, comprising FIGS. 2A, 2B and 2C, it will be seen that cartridge 20 is installed by pushing it into its cartridge compartment 18 with a natural downward motion D until a horizontal datum surface 40 (FIG. 3B) contacts a corresponding supporting surface 42 (FIG. 5B) on the floor of the cartridge compartment 18, and then rotating the cartridge 20 rearwardly (FIG. 2C) with a natural rearward motion R with vertical datum surface 44 (FIG. 3B) in contact with a corresponding supporting surface 45 (FIG. 5B) defined in an opening 19 (FIG. 5) in the floor of the cartridge compartment 18, until an upper datum surface 46 (FIG. 3A) in the cartridge 20 contacts a corresponding supporting surface 48 (FIG. 4) on the upper rear of the cartridge compartment 18. At that position, the snout portion 74 of the cartridge 20 will protrude through the opening 19 (FIG. 5A) on the floor of the cartridge compartment 18, which is accordingly referred to hereinafter as the "snout opening", with its nozzle plate 30 immediately above a sheet of printing medium (not shown).

Figure 3A:
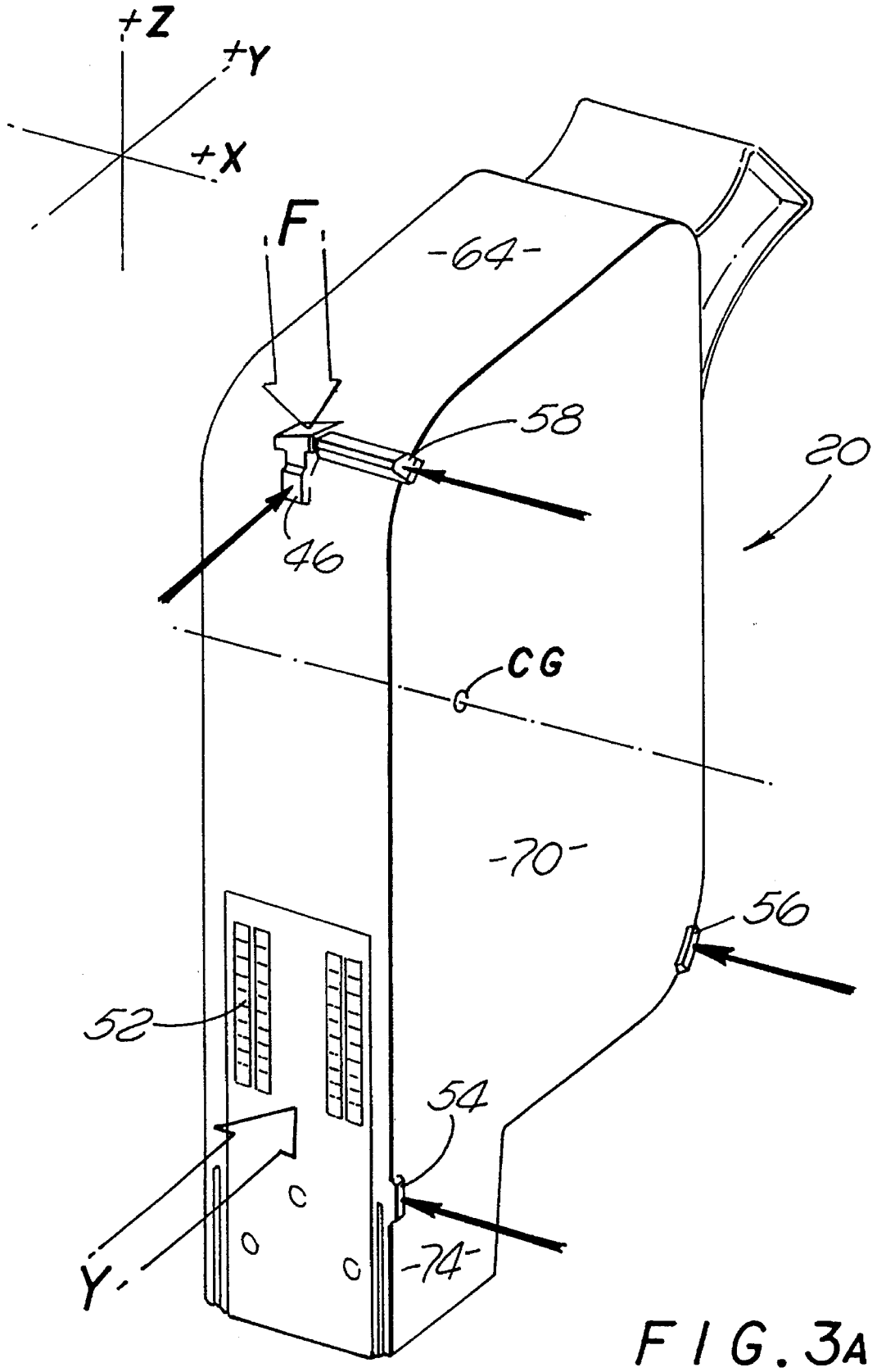
FIGS. 3A and 3B are isometric views of the cartridge of FIG. 2 as seen from the top rear and bottom front, respectively, and show the six "datum" surfaces provided in the cartridge, as well as the various registration forces which are applied to the cartridge to maintain these surfaces against corresponding registration features provided in the cartridge holder.
Figure 3B:
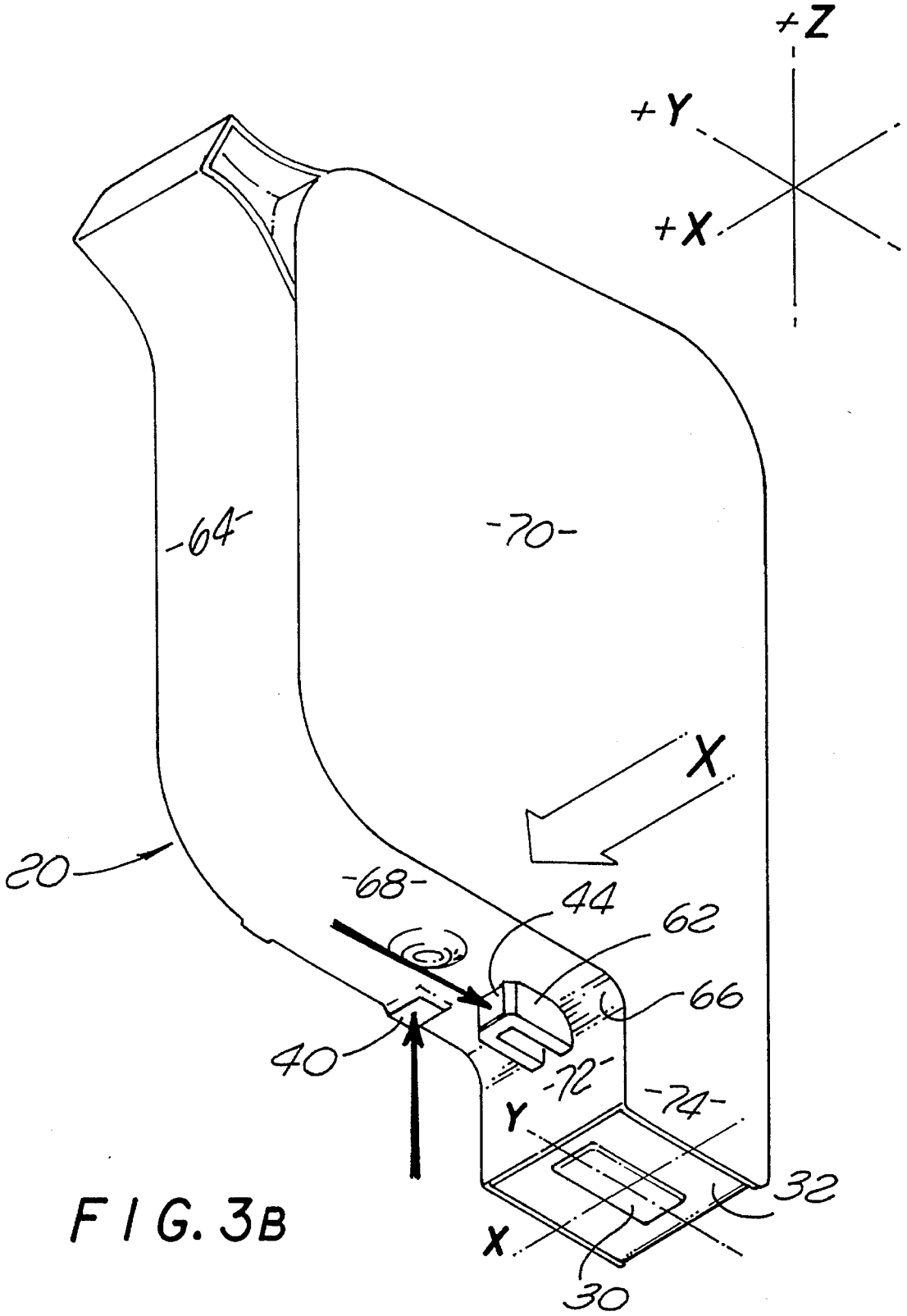

Reference should now be made to FIG. 3 (comprising FIGS. 3A and 3B, which are isometric views of cartridges 20 as seen from the top rear and bottom front, respectively), which shows the three side-biased "datum" surfaces provided in the cartridge 20 in addition to the above-mentioned datum surfaces 40, 44, 46, namely, three datum surfaces 54, 56, 58 on one side of cartridge 20, which cooperate to define an Y-Z orientation plane substantially perpendicular to the nozzle plane defined by nozzle plate 30 and substantially parallel to its Y axis. It will also be noted that vertical datum surface 44 is defined on a reenforcing bracket 62 integrally formed in the perimeter wall 64 of cartridge 20 at a juncture 66 of a downwardly facing surface 68 of the ink reservoir portion 70 and a forwardly facing portion 72 of the snout portion 74.

Figure 9:
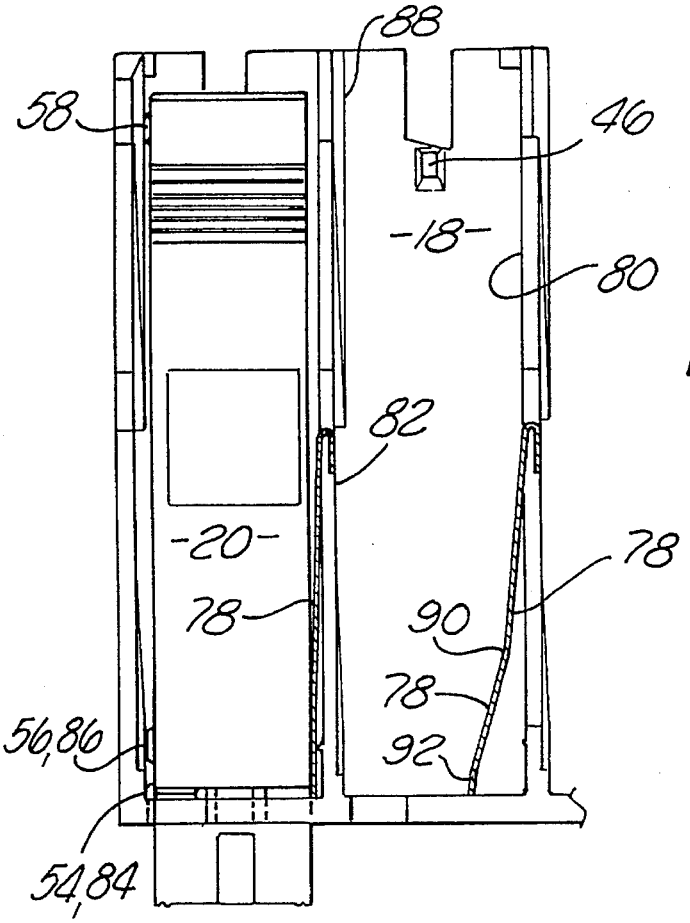
FIG. 9 is a front view, partly in cross section, of respective occupied and empty compartments of the cartridge holder, showing how a relatively thin cantilevered leaf spring provides a sideways bias force in the X axis at the lower end of the cartridge.

FIG. 3 also shows the various registration forces which, when applied to the cartridge 20, serve to maintain these surfaces against corresponding registration features provided in the cartridge holder 16, namely a first sideways force X1 applied in the +X direction to the lower part of ink reservoir 70, a forward force Y applied in the +Y direction in the vicinity of electrical interface 52, and a third force F applied in the vicinity of upper rear datum surface 46 and upper side datum surface 58 and having a sideways component X2 in the +X direction and a downwards component Z in the −Z direction. The three side-biased datum surfaces 54, 56, 58 are located on the edge of the perimeter wall 64 of the cartridge 20 for engaging respective supporting surfaces 84, 86 and 88 (FIG. 9) to thereby provide additional rigidity and positional accuracy relative to the X axis, and are spaced apart from each other in the form of a triangle which surrounds the center of gravity CG of the cartridge, thereby facilitating a more accurate and stable alignment. Furthermore, since the downwards component Z of force F is offset horizontally in the +Y direction from horizontal datum surface 40 and associated supporting surface 42, the resultant counterforce from supporting surface 42 generates a net torque T which rotates cartridge 20 about pivot axis P, thereby forcing upper rear datum surface 46 into contact with sixth supporting surface 48.

The two lower side-facing datum surfaces 54, 56 are provided to ensure that Y axes of the respective nozzle plates 30 are parallel and accurately spaced apart. Lower vertical datum surface 44 is provided to ensure that all the X axes of the nozzle plates 30 are aligned. In an exemplary embodiment, the cartridge 20 has a nominal height (not including snout portion 74) of 78 mm, a depth of 60 mm and a width of 19.18 mm; the nominal center-to-center spacing of the nozzle Y axes (and thus of the cartridges 20 and compartments 18) is 23.24 mm; the horizontal distance between the datum 54 and 56 is 47.8 mm; and each cartridge 20 has 150 nozzles arranged in two columns, each of about half an inch (12.7 mm) long, and with an inter-column spacing s (FIG. 8) of 4 mm. High quality 4 color printing is obtained when each of the supporting surfaces 84, 86 is held to a tolerance of ±0.025 mm from its nominal spacing to the corresponding surface of an adjacent compartment 18 and the alignment of the three critical supporting surfaces 45, 84, 86 on cartridge holder 16 is such that they do not deviate more than ±0.0125 mm from a respective X-Z or Y-Z plane, and when the corresponding datum surfaces 44, 54, 56 of cartridge 20 do not deviate from the respective X-Z or Y-Z plane defined by the nozzle X and Y nozzle axes by more than ±0.020 mm.

Figure 4:
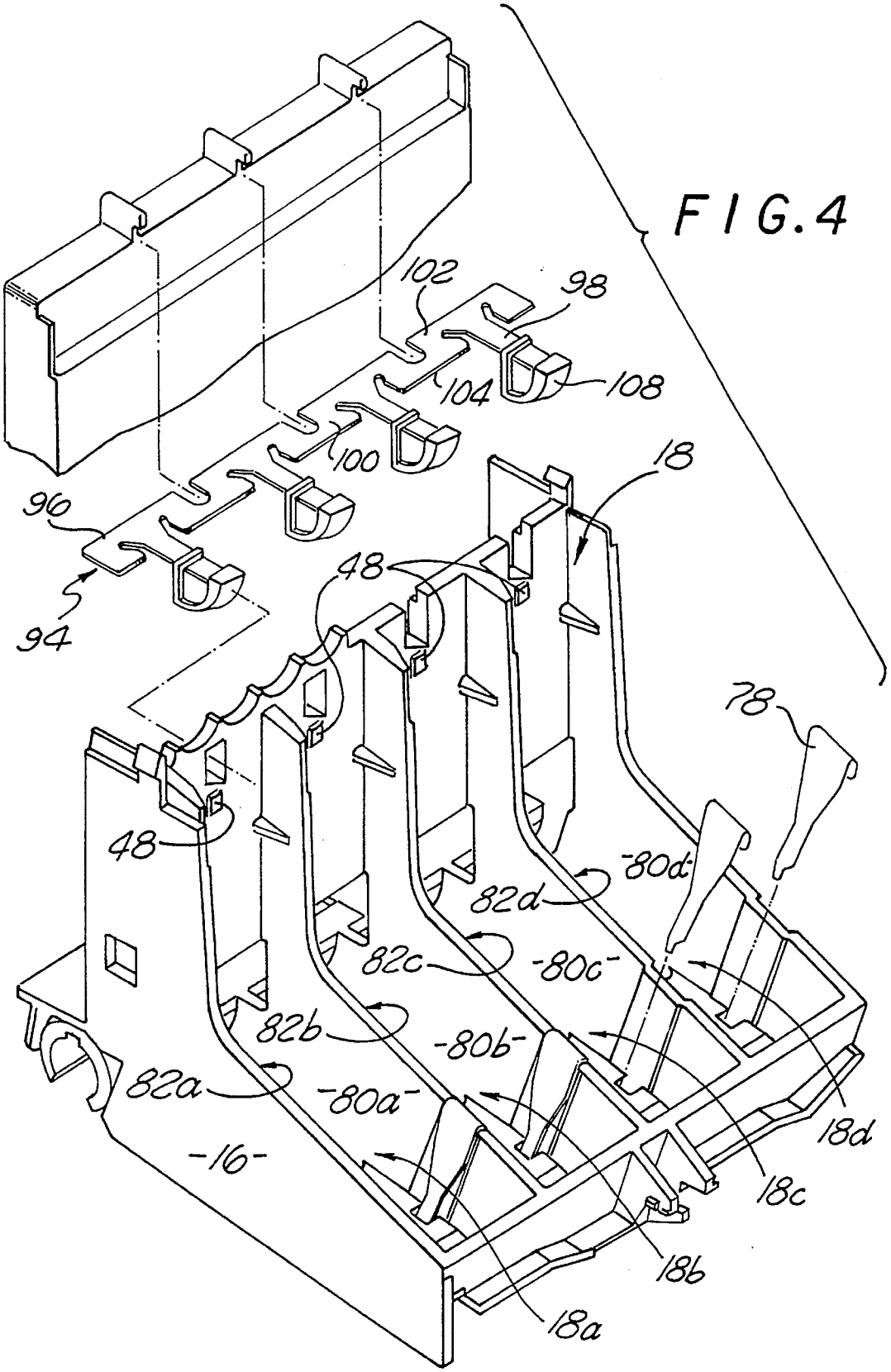
FIG. 4 is an exploded isometric view of the cartridge holder and the various springs which hold the cartridges with their respective datum surfaces in contact with the respective registration features provided in each compartment of the cartridge holder.

FIG. 4 is an exploded isometric view of the cartridge holder 16 and the various springs which hold the cartridges 20 with their respective datum surfaces in contact with the respective registration features provided in each compartment of the cartridge holder. In particular, it will be seen that a downwardly projected cantilevered leaf spring 78 for providing the first sideways force X1, is attached at about mid-point to a sidewall 80 of each cartridge compartment 18 opposite the sidewall 82 carrying the three supporting surfaces 84, 86, 88 corresponding to the three datum surfaces 54, 56, 58 (see FIG. 9). When fully compressed, leaf spring 78 approximates a straight line parallel to sidewall 80 with lower end 92 in contact with the lower end of ink reservoir 70 and thus is capable of providing a substantial sideways bias force X1 of approximately 13N at the desired location without adding substantial width to the cartridge holder 16.

The upper portion of FIG. 4 shows a latch assembly 94 for securing all four cartridges 20 inside their respective cartridge compartments 18 of cartridge holder 16. Latch assembly 94 comprises a metallic spring 96 stamped from full hard stainless steel, and comprises four forwardly facing latch ends 98 separated by five respective forwardly facing supporting ends 100. Preferably, each latch end 98 is connected to its two adjacent supporting ends 100 by a serpentine arm 102 defined by suitable radiused cutouts in stamped spring 96 to provide a shape that approximates a constant stress geometry.

Figure 5A:
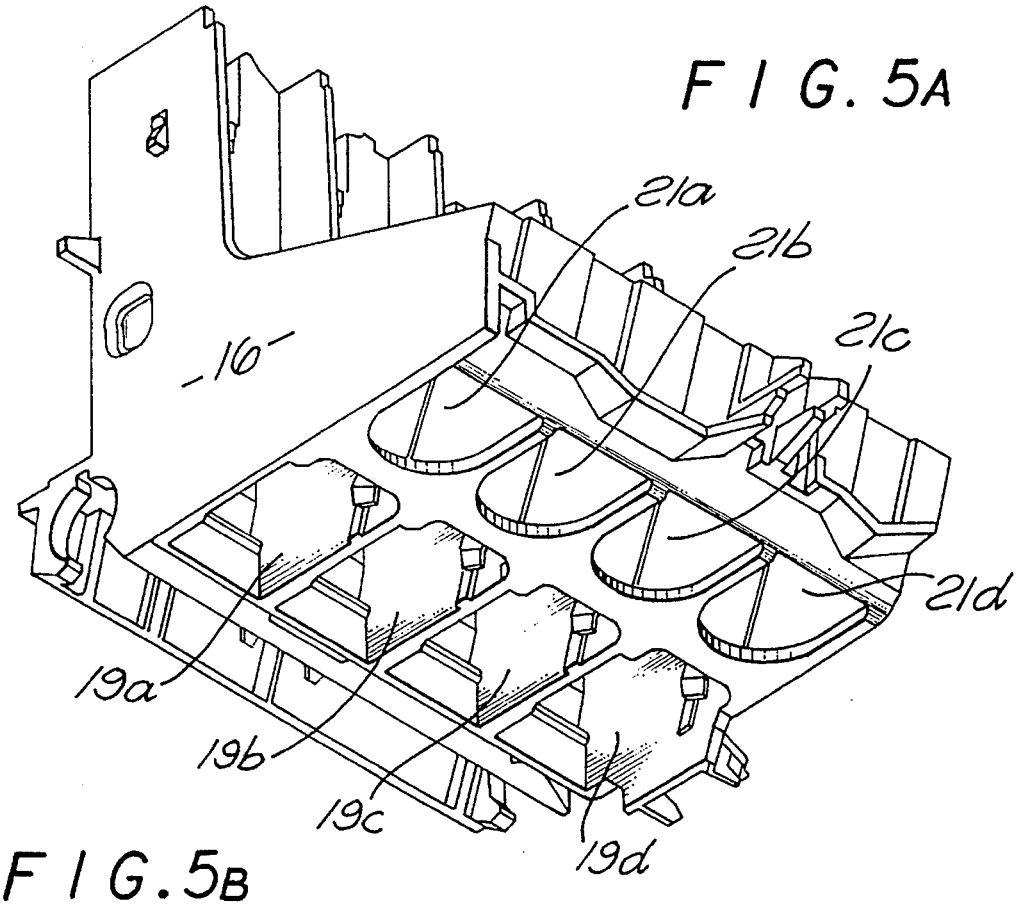
FIGS. 5A and 5B, are a bottom-front isometric view and a top view of the cartridge of FIG. 2 and show the snout opening and the compensatory opening of the cartridge.
Figure 5B:
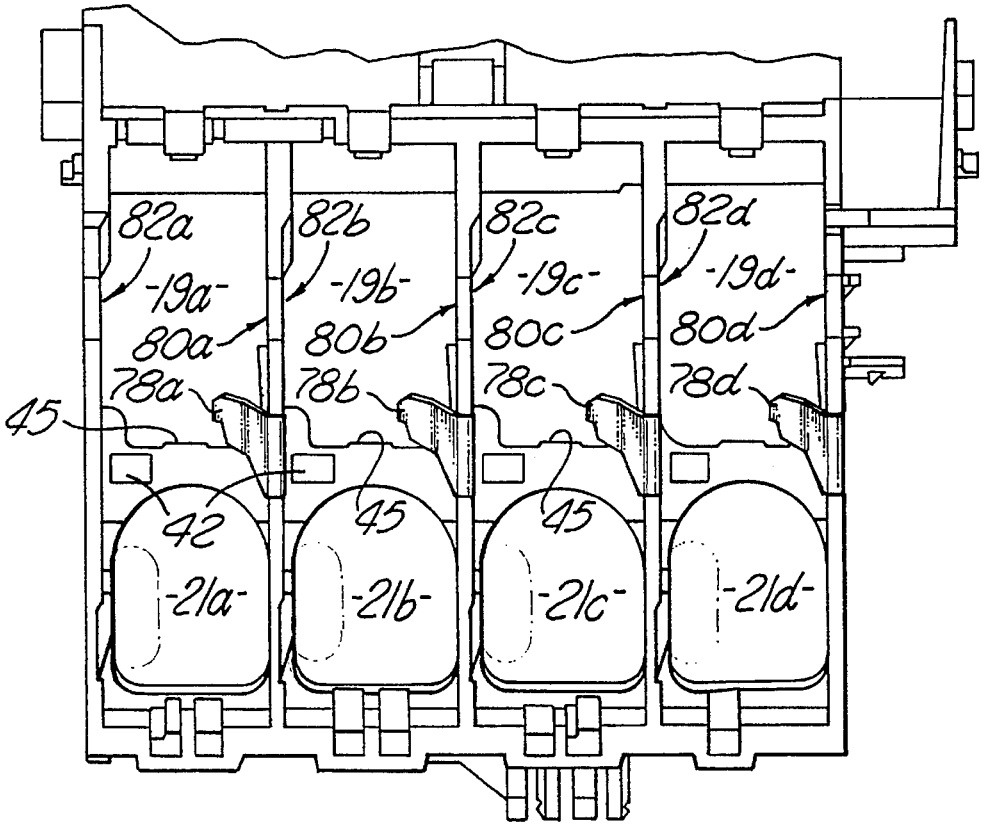
Figure 6A:
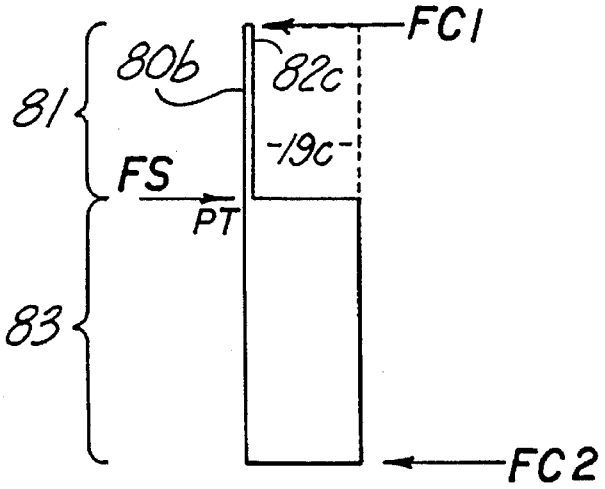
FIG. 6A shows the force exerted by the holding leaf spring against the compartment wall and the forces exerted by the adjacent cartridge in opposition to the holding force when no compensation is made to offset the deflection.
Figure 6B:
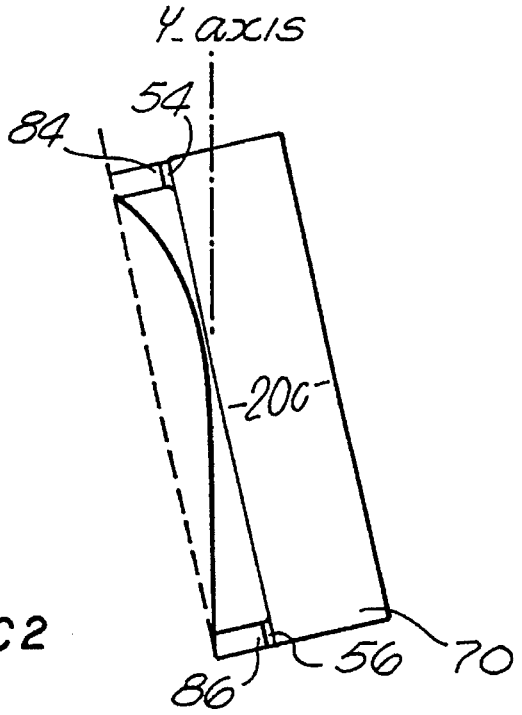
FIG. 6B shows the shape of the deflected compartment wall when no compensation is made to offset the deflection and the orientation of the cartridge resulted from the deflection.
Figure 8A:
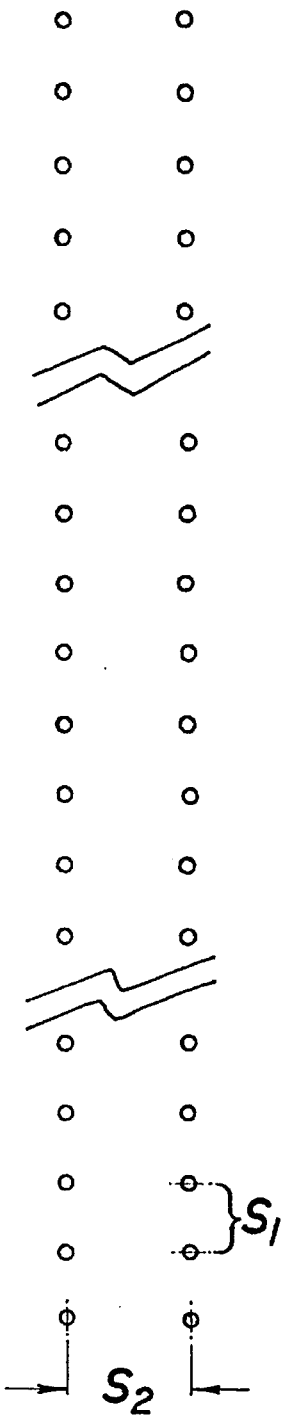
FIG. 8 comprises FIG. 8A which shows two consecutive columns of pixels printed when there is no deflection in the compartment wall and FIG. 8B which shows the two consecutive columns of pixels printed when the compartment wall deflects.
Figure 8B:
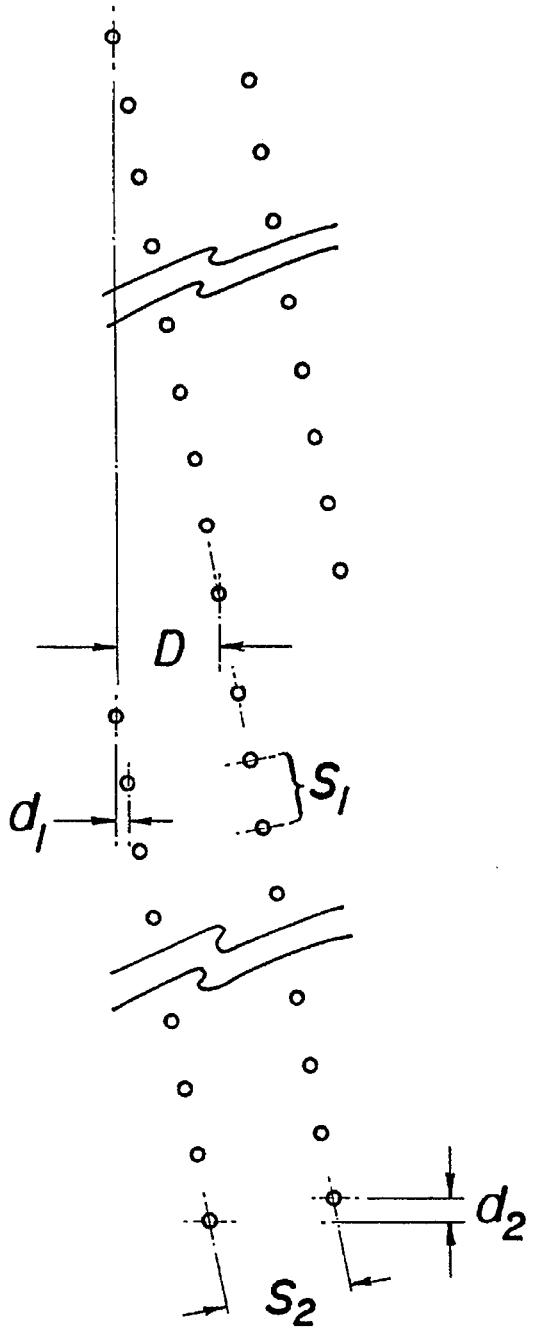

Referring to FIG. 5, which comprises FIGS. 5A and 5B, the snout opening 15 of each compartment 18 is located predominantly on the rear side of the leaf spring 78. When leaf spring (e.g., 78*b*) pushes the corresponding cartridge (i.e., 20*b*) against the compartment wall (i.e., side 82*b*), it also exerts an equal and opposite force FS on the compartment wall (i.e., side 80*b*) at the point PT where the leaf spring 78*b* is attached (see FIG. 6). In reaction, the adjacent cartridge (i.e., 20*c*) exerts forces FC1 and FC2 on the compartment wall (i.e., side 82*c*). Each of the forces FC1 and FC2 tends to bend the compartment wall 80*b*/82*c* about the point PT. However, because the snout opening 19*c* decreases the floor's support to the compartment wall 80*b*/82*c*, the compartment wall 80*b*/82*c* on the rear side 81 will deflect more than the compartment wall 80*b*/82*c* on the front side 83. As a result, cartridge 20*c* will tilt from the Y-axis as shown in FIG. 6B. When the cartridge 20*c* tilts, the columns of pixels printed by the cartridge 20*c* are no longer perpendicular to the carriage axis, and the pixel columns printed in successive sweeps will no longer be linear as shown in FIG. 8A, but will appear as shown in FIG. 8B with a horizontal displacement D between the pixel at the bottom of one column and the pixel at the top of the lower column. In the above described embodiment, deflection of the compartment wall will cause a maximum horizontal displacement (see FIG. 8B) of about 0.16 mm between datum surfaces 54 and 56 (i.e., an angle of deflection of about 0.192 degree). Since the swath height (i.e. the distance between the top nozzle and the bottom nozzle) is 12.7 mm, the horizontal displacement D between the top nozzle and the bottom nozzle is therefore 0.043 mm, which corresponds to a vertical displacement d2 of about 0.013 mm between two horizontally adjacent pixels, which is on the same order of magnitude as the longitudinal pixel spacing of about 0.042 mm for high quality print density of 600×600 pixels per square inch.

To maintain the print quality, orientation of the cartridges 20 must therefore be maintained so that they remain substantially perpendicular to the carriage axis even under the holding force of the leaf spring 78.

One solution to the above-identified problem is to replace the leaf spring 78 with two springs disposed at respective ends of the compartment wall. As will be understood from FIG. 6A, if leaf spring 78 is replaced by two springs, one applied opposite to FC1 and the other applied opposite to FC2, the bulk of the force from each of the springs will be transferred directly to an adjacent front or rear wall of the compartment and a much smaller bending moment will be experienced by the side walls of the compartment; however, such a solution requires additional parts and assembly steps.

Another solution to the above-identified problem is to provide a brace, outside the cartridge holder 16 (i.e., the left-hand side of the carriage 12 as shown in FIG. 4) so as to strengthen the compartment walls against any lateral deflection and thereby at least partially compensate for the loss of rigidity caused by the snout opening; however, this requires additional material and increases the effective width of the carriage and thus the overall footprint of the printer.

Figure 7A:
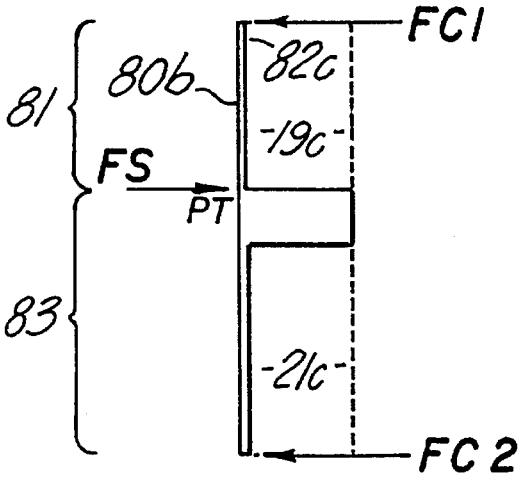
FIG. 7A shows the force exerted by the holding leaf spring against the compartment wall and the forces exerted by the adjacent cartridge in opposition to the holding force when compensatory is made to offset the deflection.
Figure 7B:
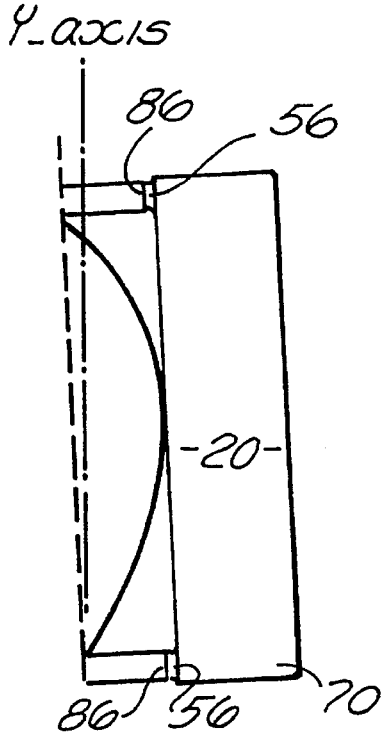
FIG. 7B shows the shape of the deflected compartment wall when compensation is made to offset the deflection and orientation of the cartridge as a result.

In accordance with the present invention, the perpendicular orientation of the cartridges 20 with respect to the carriage axis is preferably at least partially compensated for by causing a relatively symmetrical deflection at front side 83 of a vertical axis in the vicinity of the leaf spring 78 so that the deflection of the compartment wall at the front side 83 of the vertical axis approximates or is equal to the deflection at the rear side 81. Referring to FIG. 5B, the compensatory deflection can be provided by creating an opening 21 in each compartment 18 on the floor at the front side 83 of the leaf spring 78 so as to minimize the otherwise relatively rigid connection between the floor and the adjacent compartment wall, and thereby increase the compliance of the front side 83 of the compartment wall in the vicinity of the floor. An advantage of this implementation is that the carriage 12 will become lighter and has less material costs. With reference to FIGS. 7A and 7B, when deflection of the compartment wall at both sides of FS are equal, the compartment wall will approximate a parabolic surface between its two supporting surfaces, and the two supporting surfaces define a tangential plane which is substantially perpendicular to the carriage axis to support the cartridge 20. The deflection at each end of the compartment wall is a function of the distance between FS and the end of the wall. The ability to increase the compliance of front side 83 of the compartment wall is therefore limited by the available floor area for a compensating opening on front side 83 of the compartment. In the above described and illustrated embodiment, the available area at the front side of the floor for such a compensating opening is limited by the need to define in the carriage floor a horizontal support surface 42 adjacent downward facing datum surface 40 on the bottom of the cartridge 70 and a vertical support surface adjacent forward facing datum surface 44 (see FIG. 5); accordingly the snout opening at the rear side is somewhat larger than the compensating opening and will reduce the deflection D from 0.043 mm to 0.01 mm.

Figure 10:
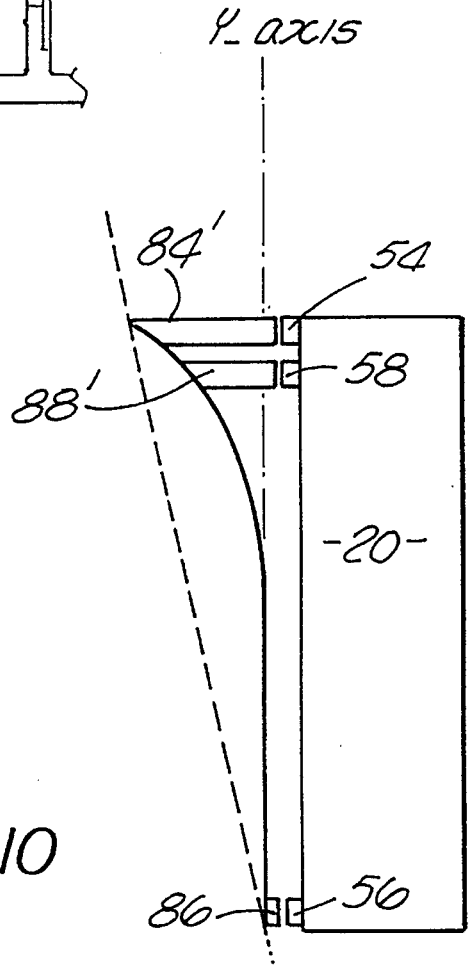
FIG. 10 shows the respective heights of the supportive surfaces on the side of the compartment wall for compensating deflection of the compartment wall.

Referring to FIG. 10, another way of compensating the deflection of the compartment wall is to increase the heights of the rear supporting datum surfaces 84, 88 relative to that of the front datum surfaces 86, thereby, in the absence of any holding forces, skewing the cartridge at a predetermined bias angle with a plane perpendicular to the carriage axis. When the height of the surfaces 84, 88 is increased (to 84', 88'), the plane formed by surface 84', 86, 88' will bias towards the left hand side when there is no cartridge in the compartment. However, when a cartridge is inserted and the compartment wall is deflected by a predetermined holding force, the plane defined by supporting surfaces 84', 86 and 88' will tend to become perpendicular to the carriage axis. Instead of increasing the height of datum surfaces 84, 88 the same effect can be accomplished by increasing the heights of datum surfaces 54, 58 on the cartridge. Positioning the cartridge at a bias angle relative to the carriage axis when no holding force is applied is a less robust design, in that it is not self compensating, and assumes a predetermined holding force and a predetermined deflection. However, it may be advantageously used in combination with the above described compensatory opening to provide a more accurate perpendicular alignment that could otherwise be achieved, particularly when there is not sufficient area for an exactly symmetrical arrangement of the snout opening and the compensatory opening.

It is understood that the above-described examples are merely provided to illustrate the principles of the present invention, and that other embodiments may readily be devised using these principles by those skilled in the art without departing from the scope and spirit of the invention.

What is claimed is:

1. An inkjet printer comprising:

a movable carriage supported above an ink-receiving medium by a rail defining a carriage axis;

a cartridge holder mounted on said carriage and having a cartridge compartment, said compartment having a compliant compartment wall on which are defined a front supporting surface and a rear supporting surface, said compartment also having a floor in which is defined a snout opening; floor in which is defined a snout opening;

an ink jet printer cartridge adapted to be removably installed in said compartment with a snout protruding through said snout opening, said snout supporting a nozzle plate with more than one nozzle for depositing ink onto said ink-receiving medium, said nozzle plate lying in a X-Y nozzle plane defined by a X nozzle axis and a Y nozzle axis wherein when said cartridge is installed in said compartment said X nozzle axis is substantially parallel to said carriage axis and said Y nozzle axis is substantially perpendicular to said carriage axis, said cartridge having a cartridge wall which is substantially perpendicular to said X-Y nozzle plane and substantially parallel to said Y nozzle axis, said cartridge wall defining a front datum surface adapted to contact said front supporting surface when said cartridge is installed in said cartridge compartment, said cartridge wall also defining a rear datum surface adapted to contact said rear supporting surface when said cartridge is installed in said cartridge compartment;

clamping means associated with said compartment wall and mounted to a middle portion of said cartridge holder for, after said cartridge has been installed in said compartment, exerting a holding force against said cartridge in a direction parallel to said carriage axis to force said cartridge against said compartment wall such that, when said cartridge is installed in said compartment, said holding force will tend to maintain said front datum surface in contact with said front supporting surface and to maintain said rear datum surface in contact with said rear supporting surfaces of the compartment, thereby causing deflection of at least a portion of said compartment wall relative to said middle portion of said cartridge holder in response to the exertion of the holding force against said cartridge, and equalizing means associated with said compartment for, after said cartridge has been installed in said compartment and said holding force has been exerted against said cartridge, maintaining the cartridge in the compartment in a position such that said Y nozzle axis of said cartridge assumes a substantially perpendicular position relative to said carriage axis after said portion of the compartment wall has been deflected in response to the holding force being exerted against said cartridge.

2. An inkjet printer as in claim 1 wherein the front supporting surface and the rear supporting surface are not deflected equally when the holding force is exerted against the cartridge, and said equalizing means comprises skew means for providing an initial biased alignment between said compartment wall and said cartridge at a predetermined bias angle with a plane perpendicular to the carriage axis prior to any deflection of the compartment wall, such that the cartridge assumes said substantially perpendicular position relative to the carriage axis only after said portion of the compartment wall has been deflected by the holding force.

3. An inkjet printer as in claim 2 wherein said skew means provides a biased datum surface on said cartridge.

4. An inkjet printer as in claim 2 wherein said skew means provides a biased supporting surface in said compartment to support said cartridge, said biased supporting surface being at said bias angle when said cartridge is not installed in said compartment.

5. An inkjet printer as in any of claims 1, 2, 3 and 4, wherein said equalizing means comprises means for providing substantially symmetrical deflection of said compartment wall at either side of a vertical axis between the front supporting surface and the rear supporting surface, such that said cartridge remains substantially perpendicular to said carriage axis as said portion of the compartment wall is being deflected by the holding force.

6. An inkjet printer as in claim 5 wherein:

said equalizing means includes a second opening in said floor.

7. An inkjet printer as in claim 6 wherein said snout opening is predominantly disposed in a first portion of said compartment;

said second opening is predominantly disposed in a second portion of said compartment; and said clamping means is disposed in a middle portion of said compartment between said first portion and said second portion.

8. An inkjet printer as in claim 7 wherein said first portion is adjacent said rear supporting surface; and said second portion is adjacent said front supporting surface.

9. A method of mounting an ink jet cartridge on a printer, the cartridge having a snout supporting a nozzle plate with more than one nozzle for depositing ink onto an ink-receiving medium, the nozzle plate lying in a X-Y nozzle plane defined by a X nozzle axis and a Y nozzle axis wherein the X nozzle axis being substantially parallel to the carriage axis and the Y nozzle axis being substantially perpendicular to the carriage axis, the cartridge having a cartridge wall which is substantially perpendicular to the X-Y nozzle plane and substantially parallel to the y nozzle axis, the method comprising the steps of:

mounting a movable carriage on a rail defining a carriage axis;

mounting a cartridge holder on said carriage for holding said cartridge, said cartridge holder having at least one cartridge compartment, said compartment having a compliant compartment wall and a floor;

providing a snout opening on said floor for receiving the snout of said cartridge;

installing said cartridge said compartment;

exerting a holding force against the thus-installed cartridge in a direction parallel to said carriage axis to force said cartridge against said compartment wall and thereby deflect at least a portion of said compliant compartment wall, and maintaining said cartridge in said compartment in a position such that said Y nozzle axis of said cartridge assumes a substantially perpendicular position relative to said carriage axis after said compartment wall has been deflected in response to said holding force being exerted.

10. The method of claim 9 wherein said maintaining step further comprises the step of:

providing a second opening on said floor to thereby cause a substantially symmetrical deflection of front and rear portions of said wall.

11. The method of claim 9 wherein said maintaining step further comprises the step of:

providing biased alignment between said compartment wall and said cartridge at a predetermined bias angle with a plane perpendicular to the carriage axis before said compartment wall has been deflected by said holding force.

* * * * *